US005355999A

United States Patent [19]

Sutherland

[11] Patent Number: 5,355,999

[45] Date of Patent: Oct. 18, 1994

[54] CLIP-TYPE ARTICLE CARRIER

[75] Inventor: Robert L. Sutherland, Kennesaw, Ga.

[73] Assignee: Riverwood International Corporation, Atlanta, Ga.

[21] Appl. No.: 136,523

[22] Filed: Oct. 14, 1993

[51] Int. Cl.[5] ..... B65D 71/12

[52] U.S. Cl. ..... 206/153; 206/147

[58] Field of Search ..... 206/145–160, 206/427

[56] References Cited

U.S. PATENT DOCUMENTS

| | | | |
|---|---|---|---|
| 2,737,326 | 3/1956 | Toensmeier | 206/153 |
| 3,144,130 | 8/1964 | Copping | 206/153 |
| 3,278,075 | 10/1966 | Weiss | 206/158 |
| 3,302,784 | 2/1967 | Copping | 206/153 |
| 3,653,503 | 4/1972 | Arneson | 206/153 |
| 4,936,455 | 6/1990 | Bienaime | 206/151 |
| 5,103,971 | 4/1992 | Schuster | 206/153 |
| 5,201,412 | 4/1993 | Schuster et al. | 206/153 |

*Primary Examiner*—Jimmy G. Foster

[57] ABSTRACT

A clip-type carrier especially suited for carrying beverage cans. The carrier is comprised of a panel having slots in a folded, wedge-shaped inner support section and in outer support sections for receiving the can chimes. In addition, short side panels and end panels assist in holding the cans in place. Webs foldably connected to end panel flaps and to extensions of the side panels cause the end panel flaps to snap into place. The end panel flaps, the webs and the side panel extensions are glued together to hold the carrier in locked condition.

20 Claims, 2 Drawing Sheets

CLIP-TYPE ARTICLE CARRIER

FIELD OF THE INVENTION

This invention relates to article carriers. More particularly, it relates to clip-type carriers that support articles from the underside of flanges or other lateral projections on the articles.

BACKGROUND OF THE INVENTION

Carriers that grip the upper portions of articles to enable the articles to be lifted and carried are known, particularly in connection with the packaging of beverage cans. The basic construction of one such type of carrier includes a panel in which arcuate slots are provided for receiving opposite portions of the can chimes. The bottom edges of the slots engage the underside of the can chimes to support the cans. This design is typically employed in packages comprised of two adjacent rows of cans, so that the elongated area of the panel between the interior slots folds into a wedge-shaped reinforcing rib extending between the sloped upper portions of the cans. In one type of carrier the panel described is the bottom panel of the carrier. Top panel flaps connected to short side panels are glued to the bottom panel, and aligned finger openings in the top panel and reinforcing wedge enable the package to be lifted and carried. Such a carrier, however, often falls short of providing the desired level of strength and is too expensive to produce.

Other can clip carrier designs have been suggested which employ only a single support panel. Although doing away with the top panel results in a lower cost carrier, problems with strength still remain, requiring the carrier to be reinforced in some manner. Unfortunately, the reinforcing means can be as costly as the top panel of the prior art carrier discussed, and can introduce additional forming problems for the packaging machine.

It would be desirable to provide a carrier which retains the benefits of known paperboard clip-type carriers, and in addition provides increased strength and economy of manufacture. Ideally, the carrier should include means to lock the cans in place separate from and supplementary to the can chime locking slots, and should be of a design which can be readily formed by a packaging machine.

BRIEF SUMMARY OF THE INVENTION

The invention is incorporated in a carrier containing adjacent rows of articles, each of which has an upper outwardly projecting lip. The carrier includes a top panel having two downwardly extending outer support sections spaced from two converging downwardly extending inner support sections. Slots in the support sections receive the projecting lips of the articles and thereby support the articles. In addition, side panels connected to the outer support sections and end panels connected to both the top panel and the side panels tightly secure the articles and lock the support sections in place.

The side and end panels are preferably held in place by glue flaps which extend from the side panels and are adhered to overlying end panel flaps. Webs foldably connecting the glue flaps to end panel flaps are located between the end panel flaps and the adjacent glue flap. During formation of the carrier, pivoting of the end panel flaps to the vertical causes the side panels and the webs to automatically move to their final positions, enabling carrier fabrication to be completed by simply folding down the end panel flaps. Foldable rib sections connect the end panel flaps and fit between the end articles in the two rows in the same manner that the inner support sections of the top panel extend down between the tops of articles in the two rows.

Although particularly useful in packaging cans, the carrier can be employed to package other articles having flanges or rims in their upper portions. By making the glue flaps part of an extension of the associated side panel, the extension is able to follow curved portions of adjacent articles at the corners of the package.

The blank for forming the carrier is comprised of a single sheet, with the end panel flaps foldably connected to the top panel. The rib sections of the end panel structure are spaced from the inner support sections in the blank so as not to interfere with the pivoting movement of the end panel flaps.

The features of the invention which enable it to provide the desired results are brought out in more detail in the description of the preferred embodiment, wherein the above and other aspects of the invention, as well as other benefits, will readily become apparent.

DETAILED DESCRIPTION OF THE PREFERRED EMBODIMENT

Figure 1:
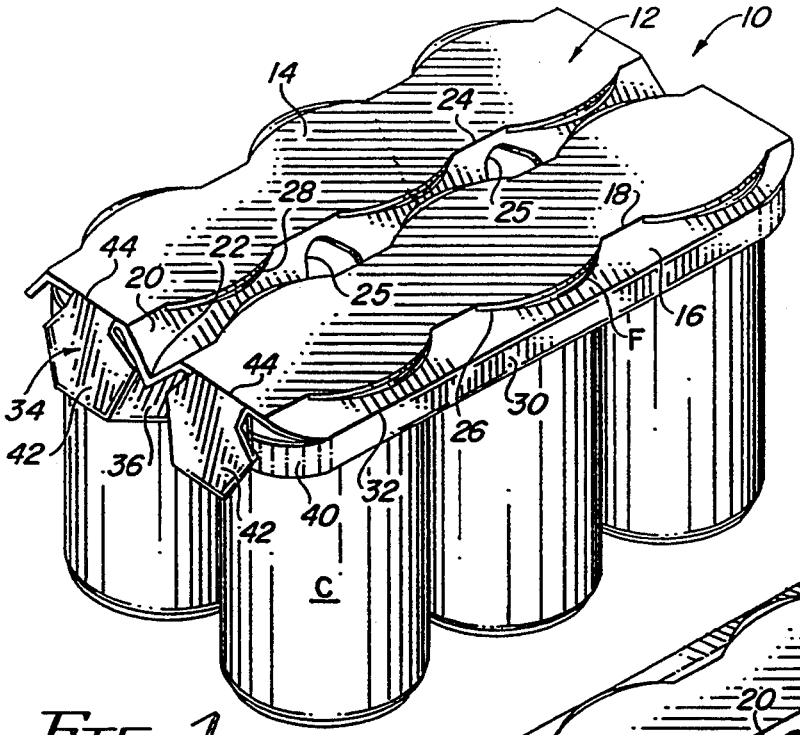
FIG. 1 is a pictorial view of a package of beverage cans the top portions of which are supported and held by the carrier of the invention.
Figure 2:
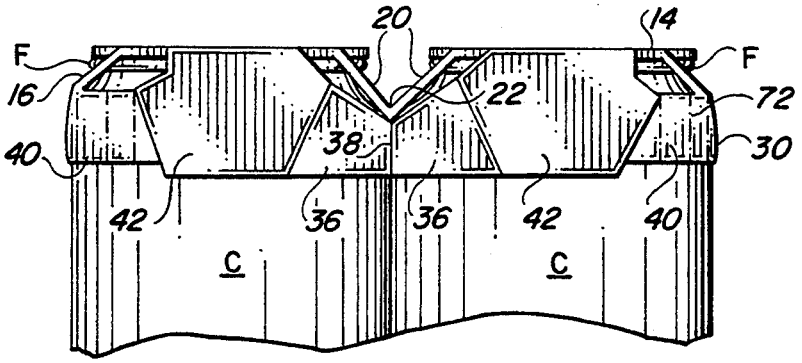
FIG. 2 is an enlarged partial end view of the package shown in FIG. 1.

Referring to FIGS. 1 and 2, a package 10 is illustrated which is comprised of the carrier 12 of the invention and two rows of cans C. The carrier includes a top panel 14 having sloped edge portions 16 which are folded down about fold lines 18. The central portion of the panel 14 includes ribs 20 which are connected to each other by fold line 22 and to the panel 14 by parallel fold lines 24. Finger holes 25 in the ribs function as a handle. Slots 26 and 28 in the edge portions 16 and ribs 20, respectively, receive the chimes or flanges F of the cans C, supporting the cans by the lower surface of the flanges. Although the carrier is illustrated is being adapted to carry six cans, it will be understood that the invention is not limited by the number of articles supported by the carrier. The articles to be carried must be arranged in a plurality of rows, however, so that the space between the tops of the cans C in adjacent rows may receive the central ribs 20.

The carrier also includes short side panels 30, connected to the top panel edge portions 16 by fold lines 32, and end panels indicated generally at 34. Each end panel includes central ribs 36 connected to each other along fold line 38, corner straps 40 extending from the side panels 30, and end flaps 42 connected to the top panel along fold lines 44. The cans are thus not only supported by their chimes, but are securely bound together about the entire periphery of the package by the combined side and end panels.

Figure 3:
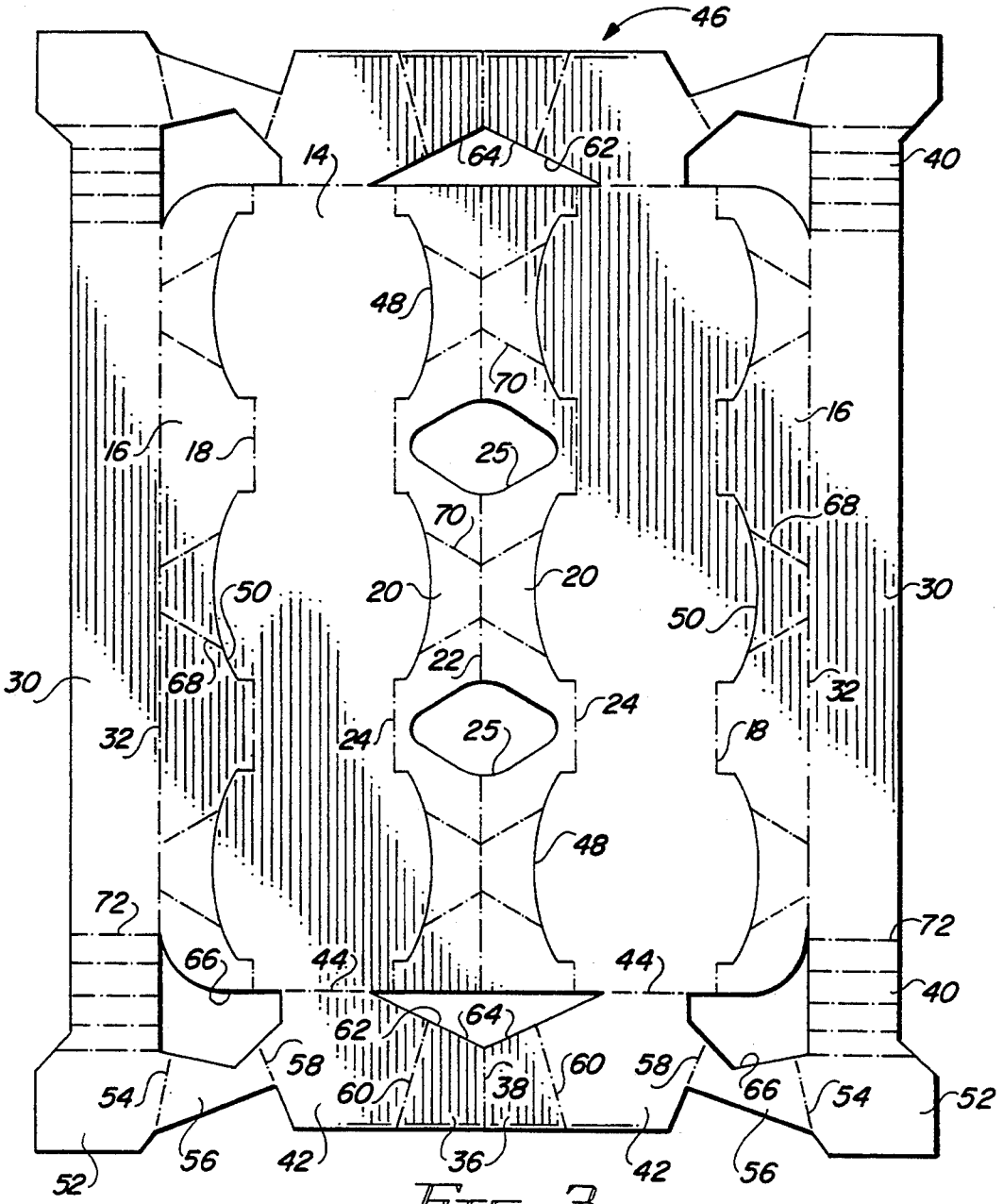
FIG. 3 is a plan view of a blank for forming the carrier.

Referring now to FIG. 3, wherein like reference numerals to those used in FIGS. 1 and 2 denote like elements, a generally rectangular blank from which the carrier 12 is formed is indicated at 46. The material of the blank should possess sufficient strength and flexibility to allow it to be folded into carrier form and to withstand the loading caused by lifting and carrying the cans or other articles. Paperboard of the type and caliper conventionally employed in the carrier industry is preferred. On each side of the centrally located fold line 22 are the fold lines 24, which in conjunction with the fold line 22 create the rib sections 20. Each fold line 24 is interrupted by three curved slits 48, which may be referred to as C-shaped slits, the convex sides of which face the central fold line 22. Each fold line 18 is also interrupted by three C-shaped slits 50 similar to the slits 48 and located so that the concave sides of the slits 50 face the concave sides of opposed slits 48 to form pairs of slits. The slits 50 form the slots 26 in the carrier, and the slits 48 form the slots 28. The C-shaped slits may be made to terminate slightly beyond their associated fold line 18 or 24, if desired, to resist the tendency to tear at this stress point.

The side panel sections 30 extend beyond the ends of the top panel section 14, terminating in enlarged glue flaps 52, which are connected by fold lines 54 to webs 56. The webs are connected at their opposite edges by fold lines 58 to the end panel flaps 42, which in turn are connected by fold lines 60 to the end panel rib sections 36. Cutouts 62 define edge portions of the rib sections 36, the end flaps 42, the rib sections 20 and the top panel 14, resulting in the rib sections 36 being spaced from the top panel section 14. The edges 64 of the cutouts which define the inner ends of the rib sections 36 are angled, meeting at a point aligned with the central fold lines 22 and 38, for a purpose explained below. Similarly, edge portions of the web panels 56, the end panel flaps 42, the top panel sections 14 and 16, the side panel section 30 and the glue flap 52 are defined by cutouts 66, resulting in the web panels being spaced from the top panel section 14.

The carrier blank also includes a number of score lines in addition to the fold lines already mentioned. Angled score lines 68 extend from the fold lines 32 to the slits 50 to facilitate the conforming of the edge panel portions 16 to the curvature of the cans and to distribute lifting stresses to the ends of the support sections. Similarly, the rib sections 20 contain angled score lines 70 for the same purposes. In addition, a series of spaced score lines 72 are provided in the end portions of the side panel sections 30 to facilitate formation of the carrier. The finger holes 25 in the central rib sections 20 are centered on the fold line 22.

To form a package, the carrier blank is positioned on top of two rows of adjacent cans so that the C-shaped slits in the blank are substantially aligned with opposite portions of the rims of the cans. Since the rib sections 20 are still in planar unfolded condition at this point, the two rows of cans will be spaced apart a short distance in order to be properly aligned with the blank, as is well known in the art. Relative movement between the blank and the cans is caused by applying downward pressure to the blank. Since the distance between the midpoints of opposite C-shaped slits 48 and 50 is substantially equal to the reduced diameter portion of a can just below the can chime, relative movement of the cans and blank causes the can chimes to be forced through the slits due to the resiliency of the paperboard until the locking edges formed by the C-shaped slits at the reinforcing rib sections 20 and the edge portions 16 snap back into the reduced diameter portion of the cans. During this maneuver, the locking edges formed by the C-shaped slits move downwardly relative to the panel 14, causing the rib sections to fold up about the fold line 22. This moves the top panel portions 14 toward each other and brings the two rows of cans into contact with each other. The carrier blank may be moved relative to the cans and the top panel flaps tightened into their final position by any suitable means. Although details of apparatus for carrying out these functions are not disclosed herein, the design of such equipment is well within the scope of those skilled in the packaging art. For example, the method of assembly disclosed in U.S. Pat. No. 3,653,503 could be employed.

Figure 4:
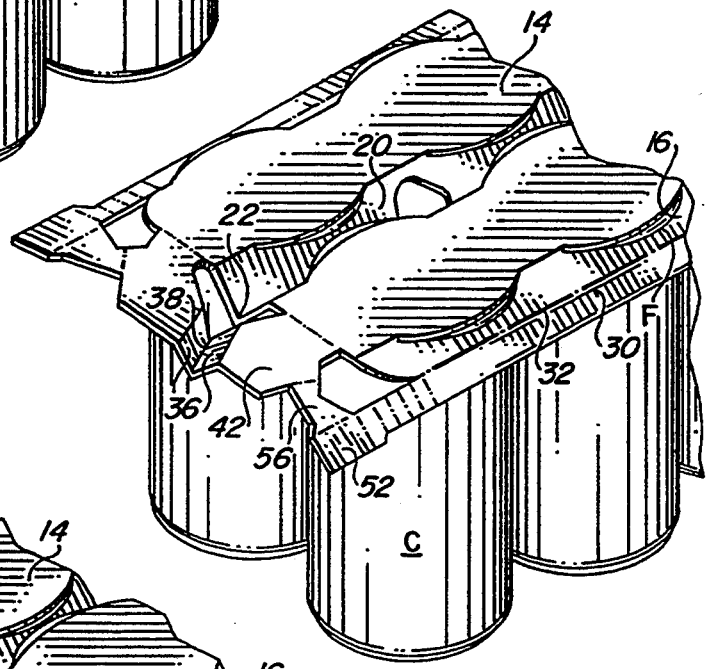
FIG. 4 is a pictorial view of the carrier at an initial stage of formation, showing it after it has been initially applied to two rows of beverage cans.

The blank at this stage of carrier fabrication is illustrated in FIG. 4. The top panel edge portions 16 are still in substantially planar relationship with respect to adjacent side panel sections 30, while the web panels 56 and their adjacent end panel flaps 42 and glue flaps 52 are also still in substantially planar relationship. The end rib sections 36, however, will have folded up about the fold line 38 in the same manner as the rib sections 20 fold up about the central fold line 22. This occurs as a result of the fold line 38 being an extension of the fold line 22.

Figure 5:
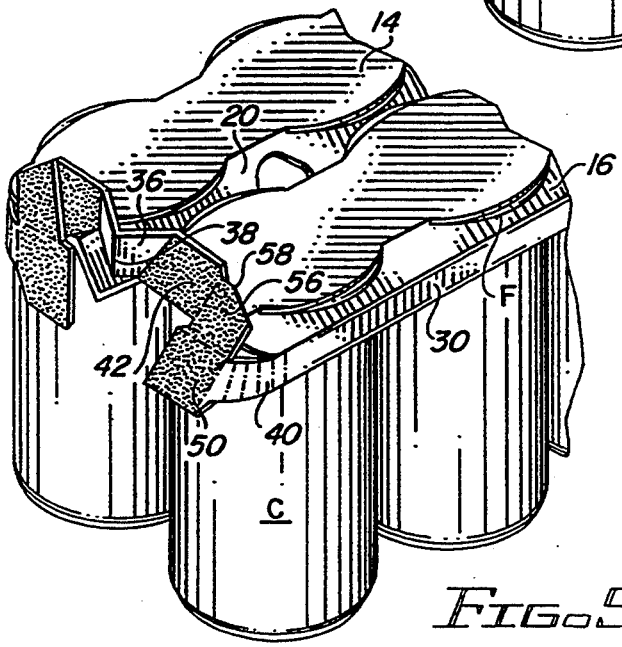
FIG. 5 is a pictorial view of the carrier at a later interim stage of formation.

The end panels are formed by first pivoting the end panel flaps 42 up about the fold lines 44, as shown in FIG. 5, so that the flaps are substantially at right angles with the top panel 14. This causes the webs 56 to fold down about their fold lines 58, drawing the glue flaps 52 toward each other and pulling the end portions of the side panel sections 30 around the peripheries of the corner cans C to the position shown in FIG. 5. The score lines 72 in these end portions assist in the smooth flexing of the end side panel portions around the cans. Movement of the glue flaps in this manner moves the fold lines 54 of the glue flaps into substantially horizontal position, so that when the end panel flaps 42 are pivoted down to the final position shown in FIG. 1, the webs fold down about the fold lines 54. When this occurs the stippled surfaces of the end panel flaps 42, the webs 56 and the glue flaps 52 are brought into contact and adhered together to hold the side and end panels in place. This ensures that the ribs 20 remain in locked position, preventing the cans from slipping out of the supporting slots.

Because the cutout 62 spaces the rib sections 20 from the end panel ribs 36, there is adequate clearance for the folded ribs 36 to move past the folded ribs 36 as the end panel flaps and connected folded ribs 36 are pivoted down from their FIG. 5 position to their final position shown in FIG. 1.

As a result of the upward pivoting movement of the end panel flaps during formation of the carrier, the corner strap extensions of the side panels are automatically drawn around the cans at the corners of the package, bringing the glue flaps 52 into position to be engaged by the underside of the end flaps 42. The cutouts 66 enable the folding action to take place by eliminating material which would otherwise bunch together and prevent a smooth continuation of the side panels 30 around the corner cans to the end panels. Adherence of the end flaps to the glue flaps holds the carrier in locked condition so that the reinforcing ribs 20 remain folded and the can chimes continue to be supported by the lower edge of the slots 26 and 28. The carrier thus combines the supporting features of a clip-type carrier with the holding power of side and end panels to provide an economical carrier capable of supporting and tightly holding the cans or other articles in place.

It will now be clear that the invention improves the strength of clip-type paperboard carriers without increasing their cost. Obviously, although the invention has been described in connection with a carrier designed to hold six beverage cans, the principles of the invention may be incorporated in carriers designed to hold fewer or more cans. Moreover, the invention is not limited to use with cans, but may be extended to other types of articles having a rim or other projection capable of being gripped by locking or supporting edges of the carrier.

Because the invention is not necessarily limited to all the specific details described in connection with the preferred embodiment, except as they may be within the scope of the appended claims, changes to certain features of the preferred embodiment which do not alter the overall basic function and concept of the invention are contemplated.

What is claimed is:

1. A carrier containing adjacent rows of articles, each article having an upper portion which includes an outwardly projecting lip, comprising:

a top panel including two downwardly extending outer support sections and two converging downwardly extending inner support sections;

the inner and outer support sections containing slots through which at least portions of the projecting lips of the articles protrude;

the slots having lower surfaces engaging the underside of the protruding portions of the article lips to thereby support the articles;

side panels connected to the outer support sections; and end panels connected to both the top panel and the side panels.

2. A carrier as defined in claim 1, wherein each end panel includes a glue flap extending transversely from the side panels and end panel flaps connected to the top panel, the end panel flaps overlying the glue flaps and being adhered thereto.

3. A carrier as defined in claim 2, wherein each end panel flap is connected to an adjacent glue flap by a web, the web being connected to the glue flap by a first web fold line and to the end panel flap by a second web fold line.

4. A carrier as defined in claim 3, wherein the first fold line extends substantially horizontally and the second fold line is in a substantially vertical plane at an angle to the horizontal.

5. A carrier as defined in claim 4, wherein the second fold line connects the end panel flaps along outer side portions of the end panel flaps.

6. A carrier as defined in claim 3, wherein the webs are located between the end panel flaps and the adjacent glue flap.

7. A carrier as defined in claim 6, wherein each web is folded about its second fold line so as to be in face-to-face relationship with the interior face of the end panel flap, and about its first fold line so as to be in face-to-face relationship with the exterior face of the associated glue flap.

8. A carrier as defined in claim 2, wherein each glue flap is part of an extension of the associated side panel, said extension following the configuration of portions of adjacent articles in the carrier.

9. A carrier as defined in claim 8, wherein the articles in the carrier include cylindrical portions extending at right angles to the top panel, the side panel extensions being curved about the cylindrical portions of adjacent articles.

10. A carrier as defined in claim 9, wherein the side panel extensions include score lines extending at right angles to the top panel to facilitate the curving of the side panel extensions about the cylindrical portions of adjacent articles.

11. A carrier as defined in claim 2, wherein the end flaps are connected to the top panel along fold lines located between the inner and outer support sections.

12. A carrier as defined in claim 11, wherein the end panel flaps at each end of the carrier are connected to each other by a pair of inner support ribs, the inner support ribs extending inwardly from the end panel and converging toward each other, the pair of inner support ribs being connected to each other along a fold line.

13. A carrier as defined in claim 1, wherein the two converging downwardly extending inner support sections of the top panel are connected to each other along a fold line.

14. A carrier as defined in claim 13, wherein the fold line connecting the inner support sections of the top panel and the fold line connecting the inner support ribs of the end panels lie in substantially the same vertical plane.

15. A carrier as defined in claim 1, wherein the two downwardly extending outer support sections and the two converging downwardly extending inner support sections are connected to the top panel along fold lines.

16. A blank for forming a clip-type carrier adapted to support adjacent rows of articles from outwardly projecting lips on the upper portions of the articles, comprising:

a sheet including two spaced parallel inner fold lines and two outer fold lines parallel to and outwardly spaced from the inner fold lines;

the sheet including outer support sections connected thereto along the outer fold lines and inner support sections connected thereto along the inner fold lines, the inner support sections connected to each other along a central fold line, thereby defining a top panel section;

each inner and outer fold line being interrupted by spaced slits forming slots in the support sections for receiving at least portions of the projecting lips of the articles to be carried;

end panel flaps connected to each end of the top panel section on opposite sides of the inner fold lines thereof by a fold line;

side panels connected to each of the outer support sections by a fold line;

glue flaps extending from each end of the side panels and being spaced from the end panel flaps; and each end panel flap being connected to the adjacent glue flap by a web, the web being connected to the glue flap by a first web fold line and to the end panel flap by a second web fold line;

the end panel flaps being adapted to overlie the glue flaps of a carrier formed from the blank.

17. A blank for forming a carrier as defined in claim 16, wherein each web is adapted to be folded about its second web fold line so as to be in face-to-face relationship with the interior face of the adjacent end panel flap in a carrier formed from the blank, and about its first web fold line so as to be in face-to-face relationship with the exterior face of one of said glue flaps in such a carrier.

18. A blank for forming a carrier as defined in claim 16, wherein each glue flap is a continuation of the associated side panel section, the glue flaps being adapted to follow the contour of cylindrical portions of articles extending at right angles to the top and bottom panels of a carrier formed from the blank.

19. A blank for forming a carrier as defined in claim 16, wherein each end panel flap is connected to a rib section along a fold line, the rib sections being connected to each other along a fold line aligned with said central fold line.

20. A blank for forming a carrier as defined in claim 19, wherein the rib sections are spaced from the inner support sections.

* * * * *